US011059072B2

(12) United States Patent
Bergmann et al.

(10) Patent No.: US 11,059,072 B2
(45) Date of Patent: Jul. 13, 2021

(54) SCREEN PLATE FOR SCREENING PLANTS FOR MECHANICAL CLASSIFICATION OF POLYSILICON

(71) Applicants: SILTRONIC AG, Munich (DE); WACKER CHEMIE AG, Munich (DE)

(72) Inventors: Andreas Bergmann, Kastl (DE); Thomas Buschhardt, Burghausen (DE); Simon Ehrenschwendtner, Winhoering (DE); Christian Fraunhofer, Mitterskirchen (DE)

(73) Assignees: SILTRONIC AG, Munich (DE); WACKER CHEMIE AG, Munich (DE)

( * ) Notice: Subject to any disclaimer, the term of this patent is extended or adjusted under 35 U.S.C. 154(b) by 50 days.

(21) Appl. No.: 15/737,728

(22) PCT Filed: Mar. 15, 2016

(86) PCT No.: PCT/EP2016/055538
§ 371 (c)(1),
(2) Date: Dec. 18, 2017

(87) PCT Pub. No.: WO2016/202473
PCT Pub. Date: Dec. 22, 2016

(65) Prior Publication Data

US 2018/0185882 A1 Jul. 5, 2018

(30) Foreign Application Priority Data

Jun. 19, 2015 (DE) ..... 10 2015 211 351.5

(51) Int. Cl.
*B07B 13/07* (2006.01)
*B07B 1/12* (2006.01)
*B07B 1/46* (2006.01)
*B07B 1/28* (2006.01)

(52) U.S. Cl.
CPC ..... *B07B 13/07* (2013.01); *B07B 1/12* (2013.01); *B07B 1/28* (2013.01); *B07B 1/46* (2013.01)

(58) Field of Classification Search
CPC .... B07B 1/00; B07B 1/12; B07B 1/28; B07B 1/16; B07B 1/46; B07B 13/07
See application file for complete search history.

(56) References Cited

U.S. PATENT DOCUMENTS 3,784,007 A * 1/1974 Skrmetta ..... B07B 13/04 209/674
4,569,446 A 2/1986 Kelley
(Continued)

FOREIGN PATENT DOCUMENTS

CN 201337987 Y 11/2009
CN 2009-544564 A 12/2009
(Continued)

*Primary Examiner* — Charles A Fox
*Assistant Examiner* — Kalyanavenkateshware Kumar
(74) *Attorney, Agent, or Firm* — Brooks Kushman P.C.

(57) ABSTRACT

Polysilicon chunks or granules are classified into size fractions using a mechanical screen having a profiled surface having peaks and valleys, and terminating in widening slots through which a polysilicon size fraction falls. The device is effective and the slots are resistant to clogging.

16 Claims, 1 Drawing Sheet

(56) References Cited

U.S. PATENT DOCUMENTS

| | | | | |
|---|---|---|---|---|
| 6,360,895 | B1 * | 3/2002 | Riggenmann | B07B 1/12 209/379 |
| 8,021,483 | B2 | 9/2011 | Arvidson et al. | |
| 2007/0235574 | A1 * | 10/2007 | Schaefer | B07C 5/08 241/36 |
| 2007/0254171 | A1 * | 11/2007 | Patel | B07B 1/4618 428/457 |
| 2009/0120848 | A1 | 5/2009 | Schaefer et al. | |
| 2010/0001106 | A1 | 1/2010 | Schaefer et al. | |
| 2010/0154357 | A1 * | 6/2010 | Wochner | B65B 25/00 53/405 |
| 2012/0198793 | A1 | 8/2012 | Vietz et al. | |
| 2014/0130455 | A1 | 5/2014 | Lazarus et al. | |

FOREIGN PATENT DOCUMENTS

| | | | |
|---|---|---|---|
| CN | 203886778 | U | 10/2014 |
| CN | 203991323 | U | 12/2014 |
| DE | 19822996 | C1 | 5/1998 |
| DE | 19945037 | A1 | 3/2001 |
| DE | 60310627 | T2 | 10/2007 |
| KR | 10-2001-0034885 | A | 4/2001 |
| KR | 10-1478872 | B1 | 1/2015 |
| SU | 1629113 | A1 | 2/1991 |

* cited by examiner

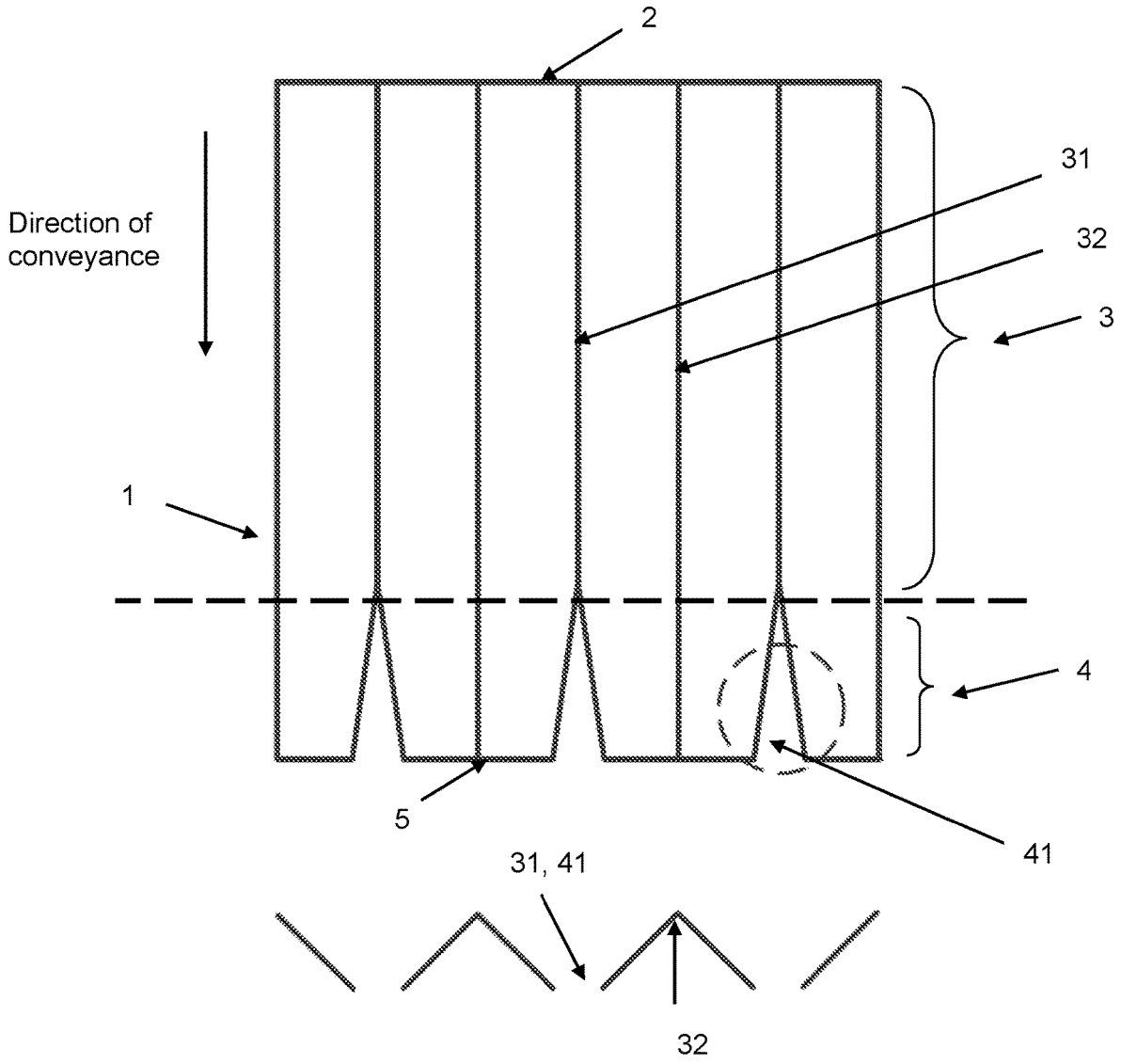
2
31
32
3
Direction of conveyance
1
4
5
41
31, 41
32

SCREEN PLATE FOR SCREENING PLANTS FOR MECHANICAL CLASSIFICATION OF POLYSILICON

CROSS REFERENCE TO RELATED APPLICATIONS

This application is the U.S. National Phase of PCT Appln. No. PCT/EP2016/055538 filed Mar. 15, 2016, which claims priority to German Application No. 10 2015 211 351.5 filed Jun. 19, 2015, the disclosures of which are incorporated in their entirety by reference herein.

BACKGROUND OF THE INVENTION

1. Field of the Invention

The invention provides a screen plate for screening plants for mechanical classification of polysilicon.

2. Description of the Related Art

Polycrystalline silicon (polysilicon or "poly" for short) serves as a starting material for production of monocrystalline silicon for semiconductors by the Czochralski (CZ) or zone melting (FZ) processes, and for production of mono- or multicrystalline silicon by various pulling and casting processes for production of solar cells for the photovoltaics sector.

Polycrystalline silicon is generally produced by means of the Siemens process. This method comprises heating support bodies, typically thin filament rods of silicon, by direct passage of current in a bell-jar-shaped reactor ("Siemens reactor") and introducing a reaction gas comprising hydrogen and one or more silicon-containing components, the polycrystalline silicon being deposited on the support bodies.

For most applications the polycrystalline silicon rods thus produced are crushed into small chunks which are typically then classified according to size. Typically, screening machines are used to sort/classify polycrystalline silicon into different size classes after comminution.

Alternatively, granular polycrystalline silicon is produced in a fluidized bed reactor. This is accomplished by fluidizing silicon particles using a gas flow in a fluidized bed and heating the bed to high temperatures using a heating apparatus. Addition of a silicon-containing reaction gas brings about a pyrolysis reaction at the hot particle surface which deposits elemental silicon on the silicon particles, and the individual particles increase in diameter.

Once produced, the granular polysilicon is typically divided into two or more fractions or classes by means of a screening plant (classification). The smallest screen fraction (screen undersize) may subsequently be processed into seed particles in a milling plant and added to the reactor. The screen target fraction is typically packed and transported to the customer. The customer uses the granular polysilicon inter alia for growing single crystals according to the Czochralski process (Cz process).

A screening machine is in general terms a machine for screening, i.e. for separating solid mixtures according to particle size. A distinction is made in terms of motion characteristics between planar vibratory screening machines and shaker screening machines. The screening machines are usually driven by electromagnetic means or by imbalance motors or drives. The motion of the screen tray conveys the charged material in the screen longitudinal direction and facilitates passage of the fines fraction through the mesh apertures. In contrast to planar vibratory screening machines, shaker screening machines effect vertical as well as horizontal screen acceleration.

One specific type of screening machine is the multideck screening machine which can simultaneously fractionate several particle sizes. These are designed for a multiplicity of sharp separations in the medium to ultrafine particle size range. The drive principle in multideck planar screening machines is based on two imbalance motors running in opposite directions to generate linear vibration. The screened material moves in a straight line over the horizontal separation surface. The machine operates with low vibratory acceleration. A modular system may be used to assemble a multiplicity of screen decks into a screen stack. Thus different particle sizes can be produced in a single machine when required without needing to change screen trays. A large screen area can be made available to the screened material through multiple repetitions of identical screen deck sequences.

U.S. Pat. No. 8,021,483 B2 discloses an apparatus for sorting polycrystalline silicon pieces comprising a vibratory motor assembly and a step deck classifier mounted to the vibratory motor assembly. The vibratory motor assembly ensures that the silicon pieces move over a first deck comprising grooves. In a fluidized bed region dust is removed via an air stream via a perforated plate. In a profiled region of the first deck the silicon pieces are deposited in holes of grooves or remain on the crests of the grooves. At the end of the first deck silicon pieces smaller than a gap between the first and the subsequent deck fall through said deck onto a conveyor. Larger silicon pieces pass over the gap and fall onto the second deck.

US 2007/0235574 A1 discloses an apparatus for comminuting and sorting polycrystalline silicon, comprising a feeding device for feeding a coarse chunk polysilicon into a crushing plant, the crushing plant, and a sorting plant for classifying the chunk polysilicon, wherein the apparatus is provided with a controller which allows variable adjustment of at least one crushing parameter in the crushing plant and/or at least one sorting parameter in the sorting plant. The sorting plant is most preferably composed of a multistage mechanical screening plant and a multistage optoelectronic separating plant.

US 2009/0120848 A1 also describes an apparatus which allows flexible classification of crushed polycrystalline silicon, characterized in that the apparatus comprises a mechanical screening plant and an optoelectronic sorting plant, wherein the chunk poly is first separated into a silicon fines fraction and a residual silicon fraction by the mechanical screening plant and the residual silicon fraction is separated out into further fractions via an optoelectronic sorting plant. The mechanical screening plant is preferably a vibratory screening machine driven by an imbalance motor. Preferred screen trays are mesh screens and perforated screens.

US 2012/0198793 A1 discloses a method of metering and packaging polysilicon chunks, wherein a product stream of polysilicon chunks is transported via a conveying channel, separated into coarse and fine chunks by means of at least one screen and weighed and metered to a target weight by means of a metering balance, wherein the at least one screen and the metering balance at least partially comprise a hard metal on their surfaces.

In the context of a method of packaging polycrystalline silicon chunks US 2014/0130455 A1 discloses that in a metering system, a fines fraction, i.e. the finest particles and shards of polysilicon, is removed by means of a screen. The screen may be a perforated plate, a bar screen, or an optopneumatic sorter.

The screens used at least partially comprise a low-contamination material on their surfaces, for example a hard metal or ceramic/carbide. The screens may be provided with a partial or complete coating of titanium nitride, titanium carbide, aluminum titanium nitride or DLC (diamond-like carbon).

Bar screens typically comprise parallel bars, the screen underflow being determined by the distance between the bars and the screen overflow exiting at the free end of the bars. In known bar screens the screen bars are arranged in a plane and transport of the screened material is effected on account of the downward incline of the screen bars toward their free end.

Prior art removal apparatuses such as bar screens are prone to blocking during fines fraction removal in packaging machines. This also applies to the known step deck classifiers which seek to remove fractions via gaps between the decks.

These removal apparatuses consequently require cleaning cycles and accordingly do not achieve continuous, consistent separation accuracy.

This additionally entails plant downtime and additional cost and inconvenience for cleaning.

Another disadvantage is that exact separation is not achieved, particularly because, in addition to the fraction to be removed, a considerable fraction of oversize is always concurrently removed. This accordingly results in an undesired reduction in the yield of the target fraction.

The object to be achieved by the invention arose from the problems described.

SUMMARY OF THE INVENTION

The object of the invention is achieved by a screen plate (1) for screening plants for mechanical classification of polysilicon comprising a feed region (2) for polysilicon, a profiled region (3) having peaks (32) and valleys (31), a region (4) having slots (41), wherein the slots (41) follow on from the valleys (31), and a takeoff region (5), wherein the slots (41) increase in size in the direction of the takeoff region (5). The object is also achieved by a method for mechanical classification of polysilicon with a screening plant, wherein the polysilicon is fed onto an aforementioned screen plate (1) which is set into vibration such that the polysilicon executes a motion in the direction of the takeoff region (5), wherein small particle-size polysilicon collects in the valleys (31) of the screen plate (1) and falls through the slots (41) of the screen plate (1) and is thus separated from the polysilicon feed.

DETAILED DESCRIPTION OF THE PREFERRED EMBODIMENTS

The polysilicon may be polycrystalline chunks or granular polysilicon.

Small particle-size polysilicon is to be understood as meaning a proportion of the polysilicon feed amount which is to be removed by means of the screening plant. The small particle-size polysilicon is thus the fraction to be removed.

The small particle-size polysilicon may be polycrystalline silicon particles which are to be removed from a target fraction comprising granular polysilicon or polysilicon chunks.

In another embodiment the polysilicon feed is polysilicon chunks comprising a fines fraction. The fines fraction is to be removed with the screen plate.

The size class of polysilicon chunks is defined as the longest distance between two points on the surface of a silicon chunk (=max. length):

chunk size (BG) 0 0.1 to 5 mm
chunk size 1 3 to 15 mm
chunk size 2 10 to 40 mm
chunk size 3 20 to 60 mm
chunk size 4 45 to 120 mm
chunk size 5 100 to 250 mm In what follows, for the chunk sizes 3 to 5 all chunks or particles of silicon of a size such that they may be removed by a mesh screen having square mesh apertures of 8 mm×8 mm in size are referred to as a fines fraction.

For the chunk sizes 0 to 2 the same analysis applies, the mesh aperture width here being defined as 1 mm×1 mm.

The screen plate comprises a feed region in which the feeding of the polysilicon is effected.

In one embodiment the polysilicon is conveyed to the screening plant and delivered to the feed region of the screen plate by means of a conveying channel.

The screen plate further comprises a profiled region having flutes or grooves, or generally, depressions and elevations, so that the profiled region has valleys and peaks.

During the motion of the polysilicon on the profiled region small chunks or small silicon particles (small with respect to the target fraction) or fines fraction collect in the valleys of the profiled region.

In one embodiment the polysilicon feed comprises chunks of the size classes 3 to 5 and a fines fraction according to the abovementioned definition. During the motion of the polysilicon on the profiled region, the fines fraction collects in the valleys of the profiled region.

In one embodiment the polysilicon feed comprises chunks of the size classes 0 to 2 and a fines fraction according to the abovementioned definition. During the motion of the polysilicon on the profiled region the fines fraction present in the polysilicon collects in the valleys of the profiled region.

Following on from the profiled region the screen plate comprises a region having slots. The slots are arranged immediately behind the valleys of the profiled region in the direction of conveyance. As a result, the fines fractions of the polysilicon present in the valleys of the profiled region are selectively passed to the slots of the region.

In one embodiment the peaks of the profiled region also continue into the region having slots so that the entire screen plate is profiled, the screen plate, however, having slots instead of valleys at its rear end in the direction of conveyance.

The removal of the fines fraction or of small chunks/particles is thus effected via the slots of the screen plate.

In one embodiment the removed fines fractions or small chunks/particles are received by a receiving container disposed below the slots of the screen plate. Larger chunks are passed over the peaks of the profiled region to the takeoff region.

In one embodiment the takeoff region is connected to a conveying channel via which the larger chunks are discharged. It is likewise possible for a further screen plate to follow on subsequently in order to remove a further fraction from the polysilicon.

The slots widen in the direction of conveyance. Surprisingly, this makes it possible to effectively avoid blockage of the openings/slots. Accordingly, the associated problems which are observed in the prior art and entail a high level of cost and inconvenience do not occur.

The separation accuracy is markedly higher than for bar screens resulting in a marked reduction in the amount of outsize removal and a consequent increase in yield.

The invention thus provides a screen plate which may be employed in all types of screening plants, where the fines fraction or small particle-size silicon material collects in valleys in the first region of the screen plate and is selectively removed through widening screen slots in the last region of the screen plate.

In one embodiment the screen plate is made of one or more materials selected from the group consisting of plastic, ceramic, glass, diamond, amorphous carbon, silicon, or metal.

In one embodiment the screen plate is lined or coated with one or more materials selected from the group consisting of plastic, polyurethane, ceramic, glass, diamond, amorphous carbon, or silicon.

In one embodiment the parts of the screen plate coming into contact with the polysilicon are lined or coated with one or more materials selected from the group consisting of plastic, polyurethane, ceramic, glass, diamond, amorphous carbon, or silicon.

In one embodiment the screen plate is made of hard metal or is coated or lined with a hard metal.

In one embodiment the screen plate comprises a metallic main body and a coating or lining of one or more materials selected from the group consisting of plastic, ceramic, glass, diamond, amorphous carbon, or silicon.

In one embodiment of the invention the plastic used in the abovementioned embodiments is selected from the group consisting of PVC (polyvinyl chloride), PP (polypropylene), PE (polyethylene), PU (polyurethane), PFA (perfluoralkoxy), PVDF (polyvinylidene fluoride) or PTFE (polytetrafluorethylene).

In one embodiment the screen plate comprises a coating of titanium nitride, titanium carbide, aluminum titanium nitride or DLC (diamond-like carbon).

The size of the slots depends on the fraction to be removed and may be up to 200 mm.

In one embodiment a separation step at 10 mm is to be effected (screening off polysilicon smaller than 10 mm), the slots having a width of 10 mm at their end (beginning of the takeoff region).

The implementation of the profiled region of the screen plate depends on the fraction to be removed. The depth and the angle of the valleys in the profiled region are to be configured such that the fraction to be removed, i.e. the fines fraction for example, collects there.

The angles of the valleys may be flat to extremely acute and may be greater than 1° and less than 180°. The depth of the valleys may be from 1 to 200 mm. For example an angle of 45° and a depth of 20 mm are suitable for removing a 10 mm fraction.

Excitation of the screen plate may be effected either with a planar vibratory screening machine or with a shaker screening machine. Vibration drives (for example magnetic drives) or imbalance drives may likewise be provided.

In one embodiment the screen plate has an inclination to the horizontal. Angles of inclination of 0-90° are possible. Angles of inclination between 5° and 20° are preferred since gravity then aids conveyance over the screen plate.

The features cited in connection with the abovedescribed embodiments of the method according to the invention may be correspondingly applied to the apparatus according to the invention. Conversely, the features cited in connection with the abovedescribed embodiments of the apparatus according to the invention may be correspondingly applied to the method according to the invention. These features of the invention and the features recited in the claims and also in the description of the figures may be realized either separately or in combination as embodiments of the invention. Said features may further describe advantageous implementations eligible for protection in their own right.

BRIEF DESCRIPTION OF THE FIGURES

FIG. 1 is a schematic diagram of the construction of a screen plate

LIST OF REFERENCE NUMERALS EMPLOYED

1 screen plate
2 feed region
3 profiled region of the screen plate
31 valleys of the profiled region
32 peaks of the profiled region
4 region having slots
41 slot
5 takeoff region The screen plate 1 comprises a feed region 2 in which feeding of the polysilicon is effected. The polysilicon may, for example, be conveyed to the screening plant and delivered to the feed region 2 of the screen plate 1 by means of a conveying channel.

The screen plate 1 further comprises a profiled region 3. This profiled region 3 provides flutes or grooves or depressions of another kind, so that the profiled region 3 has valleys 31 and peaks 32.

The fines fraction present in the polysilicon collects in the valleys 31 of the profiled region 3 during the motion of the polysilicon on the profiled region 3.

The screen plate 1 comprises—following on from the profiled region 3—a region 4 having slots 41. The slots 41 are arranged immediately behind (in the direction of conveyance) the valleys 31 of the profiled region 3. As a result the fines fractions of the polysilicon present in the valleys 31 of the profiled region 3 are selectively passed to the slots 41 of the region 4.

The peaks 32 of the profiled region 3 preferably also continue in the region 4 so that the entire screen plate 1 is profiled but has slots 41 instead of valleys 31 in the region 4.

The removal of the fines fraction is thus effected via the slots 41 of the screen plate 1. The removed fines fractions may, for example, be received by a receiving container disposed below the slots 41 of the screen plate 1.

Larger chunks are passed over the peaks 32 in the profiled region to the takeoff region 5.

The slots 41 widen in the direction of conveyance. It has been found that this makes it possible to effectively avoid blockage of the openings/slots.

The description hereinabove of illustrative embodiments is to be understood as being exemplary. The disclosure made thereby enables a person skilled in the art to understand the present invention and the advantages associated therewith and also encompasses alterations and modifications to the described structures and methods obvious to a person skilled in the art. All such alterations and modifications and also equivalents shall therefore be covered by the scope of protection of the claims.

The invention claimed is:

1. A profiled screen plate for removal of polysilicon fines from larger chunks of polysilicon in a screening plant for the mechanical classification of polysilicon, the screen plate comprising:

a feed region for receiving a feed of polysilicon, a profiled region having peaks and valleys, and a region having slots which follow on from the valleys, and a takeoff region, wherein the slots increase in size toward the direction of the takeoff region, and wherein the peaks of the profiled region continue into the region having slots so that the entire screen plate is profiled such that the height of the peaks and valleys extending across the profiled region to the end of the takeoff region are constant, the screen plate having slots instead of valleys at its end in the direction of conveyance, the height of the peaks and the maximum width of the slots in the takeoff region configured such that a fines fraction of polysilicon chunks is removed from the feed of polysilicon, wherein the fines fraction removed is defined as silicon chunks which can pass through a mesh screen having square mesh apertures of 8 mm×8 mm in size when chunks having chunk sizes of 20 mm to 250 mm are being classified, and is defined as silicon chunks which can pass through a mesh screen having square mesh apertures of 1 mm×1 mm when chunks having chunk sizes of 0.1 to 5 mm are being classified.

2. The screen plate of claim 1, which is constructed of elemental silicon, or has a covering of elemental silicon.

3. The screen plate of claim 1, wherein the valleys of the profiled region are from 1 to 200 mm deep.

4. The screen plate of claim 1 which is made of one or more materials selected from the group consisting of plastic, ceramic, glass, diamond, amorphous carbon, silicon and metal.

5. The screen plate of claim 1, comprising a metallic main body and a coating or lining of one or more materials selected from the group consisting of plastic, ceramic, glass, diamond, amorphous carbon and silicon.

6. The screen plate of claim 1, comprising a coating of titanium nitride, titanium carbide, aluminum titanium nitride or DLC (diamond-like carbon).

7. The screen plate of claim 1, which is made of hard metal or which is lined or coated with a hard metal.

8. The screen plate of claim 1, wherein the slots have a width of up to 200 mm.

9. The screen plate of claim 1, wherein an opening angle of the valleys of the profiled region is greater than 1° and less than 180°.

10. The method of claim 1, wherein the screen plate has an angle of inclination to the horizontal of from 5° to 20°.

11. The screen plate of claim 1, wherein the valleys have a depth of 20 mm.

12. The screen plate of claim 1, wherein an included angle of the profiled region is 45°.

13. A method for the mechanical classification of polysilicon employing a screening plant, comprising feeding polysilicon onto a profiled screen plate of claim 1, and vibrating the screen plate such that the polysilicon executes a motion in the direction of the takeoff region, wherein the fines fraction collects in the valleys of the screen plate and fall through the slots of the screen plate and is thus separated from the polysilicon feed.

14. The method of claim 13, wherein silicon chunks classified are of chunk size 0 to 2, and the fines are polysilicon chunks which can pass through said 1 mm×1 mm screen.

15. The method of claim 13, wherein silicon chunks classified are of chunk size 3 to 5, and the fines are polysilicon chunks which can pass through said 8 mm×8 mm screen.

16. The method of claim 13, wherein the profiled screen plate has a surface which contacts the polysilicon chunks which comprises elemental silicon.

* * * * *